US005348069A

United States Patent [19]

Shibahara et al.

[11] Patent Number: 5,348,069

[45] Date of Patent: Sep. 20, 1994

[54] LOST FOAM PATTERN FOR MOLDING AND METHOD OF MAKING SAME

[75] Inventors: Masahiko Shibahara; Nobuhide Takeshige; Hiroshi Asai; Motofumi Omori, all of Hiroshima, Japan

[73] Assignee: Mazda Motor Corporation, Hiroshima, Japan

[21] Appl. No.: 976,069

[22] Filed: Nov. 13, 1992

[30] Foreign Application Priority Data

Nov. 15, 1991 [JP] Japan ..... 3-328139

[51] Int. Cl.[5] ..... B22C 9/04

[52] U.S. Cl. ..... 164/34; 164/45

[58] Field of Search ..... 164/45, 34, 35, 516, 164/235, 246

[56] References Cited

U.S. PATENT DOCUMENTS 4,766,942 8/1988 Wessman et al. ..... 164/45
4,819,711 4/1989 Chancellor ..... 164/34

FOREIGN PATENT DOCUMENTS 61-195729 8/1986 Japan ..... 164/34
3-85146 8/1991 Japan .
238110 7/1969 U.S.S.R. ..... 164/34

*Primary Examiner*—Kuang Y. Lin
*Attorney, Agent, or Firm*—Keck, Mahin & Cate

[57] ABSTRACT

A molding lost foam pattern made out of synthetic resin is decomposed and gasified by molten metal. The molding lost foam pattern includes a runner portion foam pattern extending vertically. The runner portion foam pattern includes a hollow portion and a base portion. A plurality of short-sized gate portion foam patterns are provided on external surfaces of the hollow portion of the runner portion foam pattern, and a product portion foam pattern is connected to the external surfaces of the hollow portion through the plurality of short-sized gate portion foam patterns. A method of making the molding lost foam pattern is also disclosed.

5 Claims, 9 Drawing Sheets

LOST FOAM PATTERN FOR MOLDING AND METHOD OF MAKING SAME

BACKGROUND OF THE INVENTION

1. Field of the Invention

The present invention relates to a lost foam pattern for molding and a method of making same, and in particular to an improvement of a lost foam pattern for molding in which foam is decomposed and gasified by molten metal and then replaced with molten metal in a lost foam pattern molding process and a method of making the same.

2. Description of Related Art

A conventional lost foam pattern for molding employs two kinds of synthetic resin, namely, expanded polystyrene and expanded polymethylmethacrylate resin. When the lost foam pattern is made out of expanded polystyrene, a carbonizing phenomenon in castings occurs because a large quantity of carbon is produced during the molten metal pouring process. On the other hand, when the lost foam pattern is made out of the expanded polymethylmethacrylate resin, the molten metal flows in the reverse direction during the molten metal pouring process, because the expanded polymethylmethacrylate resin is gasified at a high speed during a decomposing process and a large quantity of gas is produced.

Japanese Utility Model Laid-Open Publication No. 3-85146 discloses a lost foam pattern for molding in which a hollow lost connecting pipe is provided between the bottom portion of a sprue and a runner, and a product foam pattern is connected with the hollow lost connecting pipe through a solid runner foam pattern and the gate portion foam pattern.

According to the conventional lost foam pattern for molding disclosed in the Japanese Utility Model, when the lost foam pattern is made out of the expanded polymethylmethacrylate resin, the lost connecting pipe can prevent the molten metal from flowing in the reverse direction during the molten metal pouring process. However, on the other hand, the conventional lost foam pattern has some disadvantages because it has a low strength for supporting the product form and produces misruns and the like.

SUMMARY OF THE INVENTION

It is therefore an object of the present invention to provide a lost foam pattern for molding and a method of making the same which can prevent the molten metal from flowing in the reverse direction during the molten metal pouring process.

It is another object of the present invention to provide a lost foam pattern for molding and a method of making the same which has sufficient strength for supporting the product foam pattern and prevents the production of misruns.

It is further another object of the present invention to provide a lost foam pattern for molding and a method of making the same which can be positioned easily and accurately.

The above and other objects of the present invention can be accomplished by a molding lost foam pattern made out of synthetic resin which is decomposed and gasified by molten metal comprising a runner portion form provided so as to extend vertically, said runner portion foam pattern including a hollow portion and a base portion, a plurality of short-sized gate portion foam patterns provided on external surfaces of the hollow portion of the runner portion foam pattern, and a product portion foam pattern connected to the external surfaces of the hollow portion through the plurality of short-sized gate portion foam patterns.

In one preferred embodiment, said synthetic resin is expanded polymethylmethacrylate resin.

The present invention also provides a method of manufacturing a molding lost foam pattern made out of synthetic resin which is decomposed and gasified by molten metal, comprising the steps of providing a runner portion foam pattern so as to extend vertically, said runner portion foam pattern including a hollow portion and a base portion, providing a plurality of short-sized gate portion foam patterns integrally on external surfaces of the hollow portion of the runner portion foam pattern, providing a product portion, adhering the product portion to the external surfaces of the hollow portion through the plurality of short-sized gate portion foam patterns so as to provide the molding lost foam pattern, coating facing material on the molding lost foam pattern, and drying the facing material coated on the molding lost foam pattern.

In one preferred embodiment of the method of the present invention, a reinforcement member is employed so as to hold the molding lost foam pattern during the coating step.

In another preferred embodiment of the method of the present invention, an upper edge opening portion of the hollow portion of the runner portion foam pattern works as both a sprue portion and a positioning portion of the reinforcement member.

Further objects, features and advantages of the present invention will become apparent from the Detailed Description of the Preferred Embodiments which follows when considered together with the attached drawings.

DESCRIPTION OF THE PREFERRED EMBODIMENTS

Figure 1:
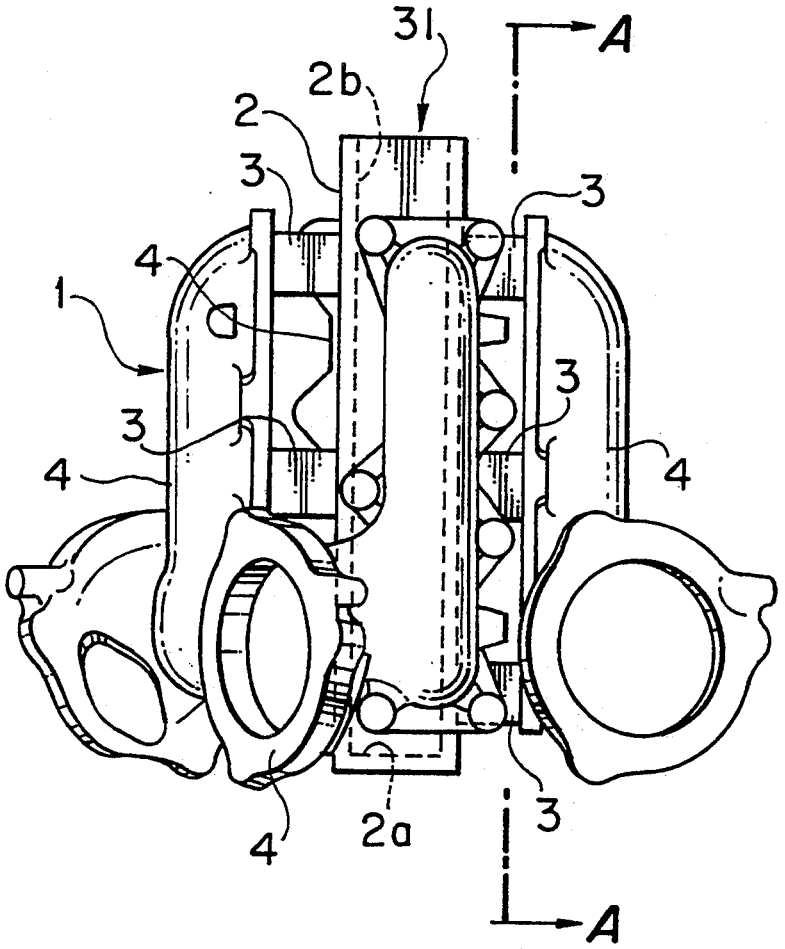
FIG. 1 is a front view of a lost foam pattern for molding according to an embodiment of the present invention.

An embodiment of the present invention will be discussed with reference to FIGS. 1–3. FIG. 1 shows a lost foam pattern for molding according to an embodiment of the present invention. As is shown in FIG. 1, a lost foam pattern 1 for molding is made out of expanded polymethylmethacrylate resin and includes a runner portion foam pattern 2, a plurality of short-sized gate portion foam patterns 3 provided on the four side surfaces of the runner portion foam pattern 2, and four product portion foam patterns 4 of an automobile exhaust manihold provided on the runner portion foam pattern 2 through the gate portion foam patterns 3.

Figure 2:
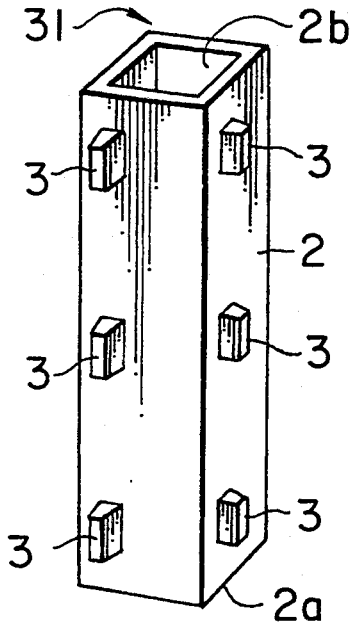
FIG. 2 is a perspective view of a runner portion foam pattern on which gate portion foam patterns are provided integrally.

FIG. 2 shows a runner portion foam pattern 2 in which the gate portion foam patterns 3 are provided integrally. As is shown in FIG. 2, the runner portion foam pattern 2 is provided with a square tubelike hollow portion 31 extending vertically and a sprue base 2*a*. An upper edge opening portion 2*b* works as both a sprue portion and a positioning portion for the lost foam pattern 1. In the embodiment of the present invention, the runner portion foam pattern 2 is about 300 mm in height, and about 60 mm square in an external portion and about 40 mm in an internal square portion thereof. Therefore, the runner portion foam pattern 2 has a ratio of about 44 percent between a hollow volume and a runner volume as it is provided with about 1080 $cm^3$ in the runner volume and about 480 $cm^3$ in the hollow volume.

Figure 3:
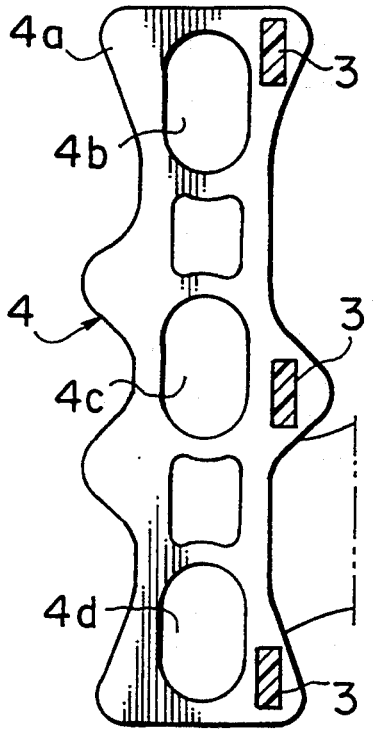
FIG. 3 is a sectional view taken along a line A—A in FIG. 1.

FIG. 3 is a sectional view taken along a line A—A in FIG. 1. As is shown in FIG. 3, three gate portions 3 are provided on each external side surface of the runner portion foam pattern 2, and the product portion foam pattern 4 is connected to the runner portion foam pattern 2 through the three gate foam patterns 3. In FIG. 3, a reference numeral 4*a* shows a flange portion of the exhaust manifold connected to a cylinder head of an engine, and reference numerals 4*b*, 4*c* and 4*d* show exhaust path portions of the exhaust manifold. The upper gate portion 3 is located in one side of the upper flange portion 4*a* which is near the upper exhaust path portion 4*b*, the center gate portion 3 is located in one side of the center flange portion 4*a* which is near the center exhaust path portion 4*c*, and the lower gate portion 3 is located in one side of the lower flange portion 4*a* which is near the lower exhaust path portion 4*d*.

Next, the method of making the lost foam pattern 1 for molding of the present invention will be described with reference to FIGS. 4–10. The lost foam pattern 1, as shown in FIG. 1, is made by the product portion foam pattern 4 being adhered to the gate portion foam patterns 3 provided integrally with the runner portion foam pattern 2. The method of making the lost foam pattern 1 includes the following processes such as an adhering process, a coating process, a drying process and the like.

Figure 4:
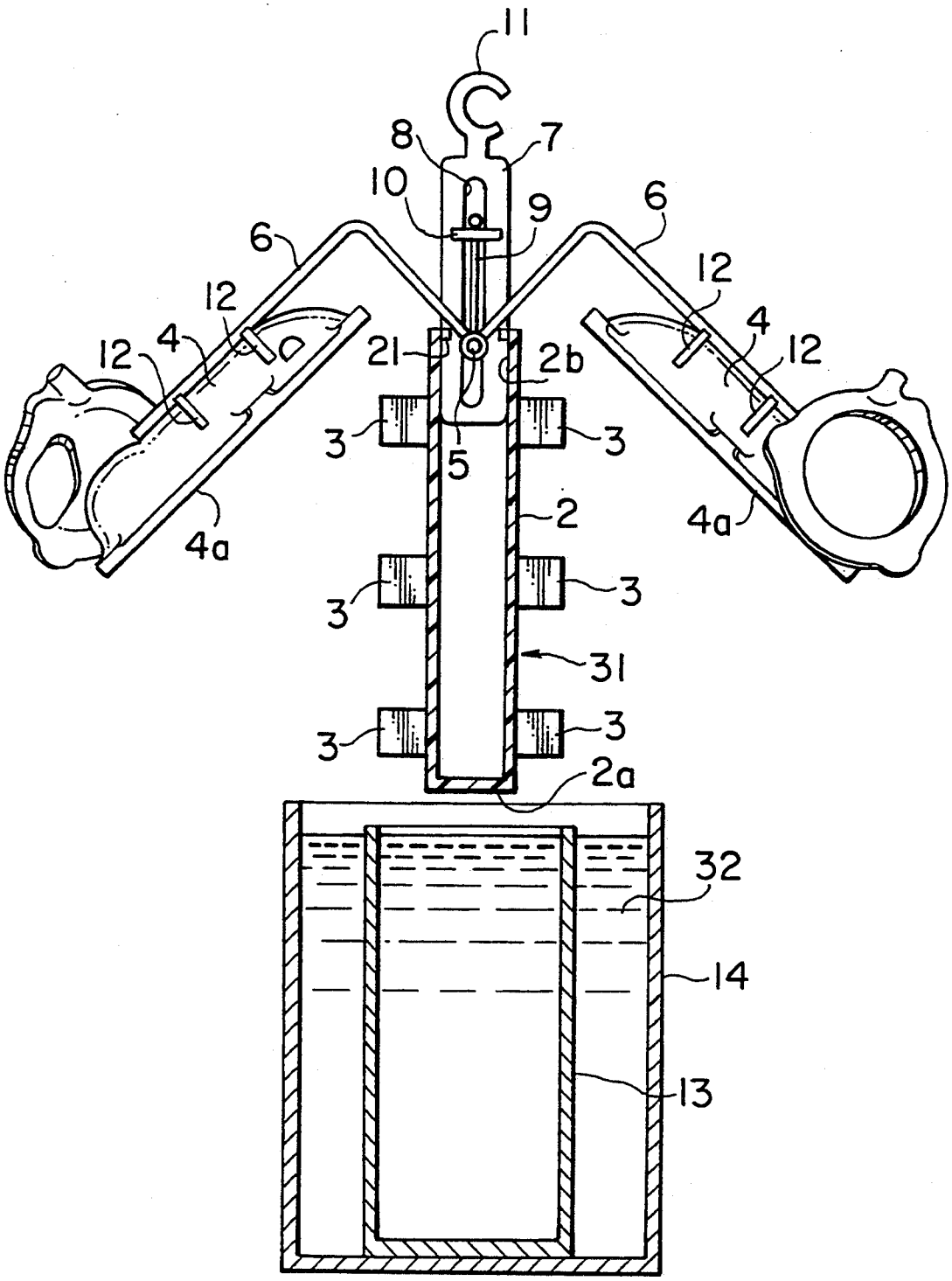
FIG. 4 is a view showing a preparation process for adhering a product portion foam pattern to gate portion foam patterns.
Figure 6:
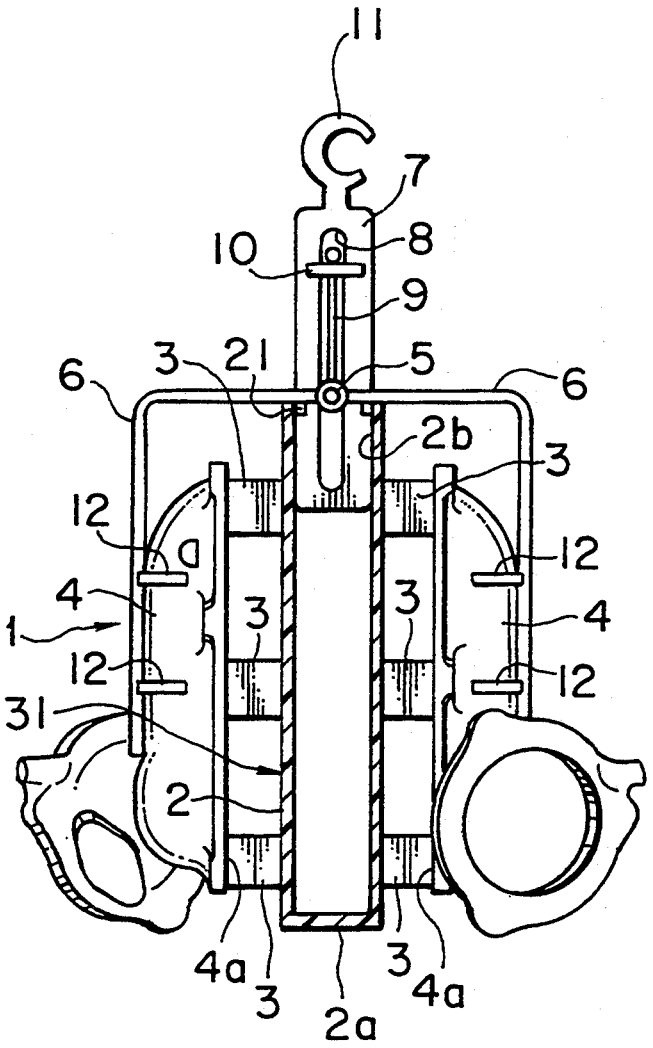
FIG. 6 is a view showing a lost foam pattern for molding in which the adhering process has been carried out.

FIG. 4 shows a preparation process for adhering a product portion foam pattern to gate portion foam patterns 3. As is shown in FIG. 4, there is provided a couple of handling devices 6 which hold the lost foam pattern 1 and are operated so as to be opened and closed around a supporting point, that is, a supporting shaft 5. The couple of handling devices 6 are provided in a predetermined position of a jig 7 through the supporting shaft 5. The jig 7 is provided with an elongated opening 8 in which a rod 9 and a knob 10 are provided so as to operate the above-mentioned supporting shaft 5 in the vertical direction so that the couple of handling devices 6 are opened and closed. That is, when the rod 9 is operated in the lower direction, the couple of handling devices 6 contact stoppers 21 and are opened as shown in FIG. 4. On the other hand, when the rod 9 is operated in the upper direction, the couple of handling devices 6 are closed as shown in FIG. 6.

The jig 7 is provided with a hook 11 on an upper edge therof, and the couple of handling devices 6 include a plurality of holding nails 12 for holding the product portion foam pattern 4. The handling devices 6 and holding nails 12 are coated by water repellent material.

The lower edge portion of the jig 7 is positioned and fixed in the upper edge opening portion 2*b* of the runner portion foam pattern 2.

There is provided an adhesive tank 14 including an adhesive supply jig 13 therein which is operated so as to be lifted and lowered by a hydraulic cylinder (not shown). In the adhesive tank 14, the adhesive which is hot melt 32, that is, ethylen-vinylacetate-copolymer heated at a predetermined temperature, is stored.

As is shown in FIG. 4, the runner portion foam pattern 2, the gate portion foam patterns 3 and the product portion foam pattern 4 to which the handling devices 6 are fixed in the open condition are conveyed to and stopped right above the adhesive supply jig 13 of the adhesive tank 14.

Figure 5:
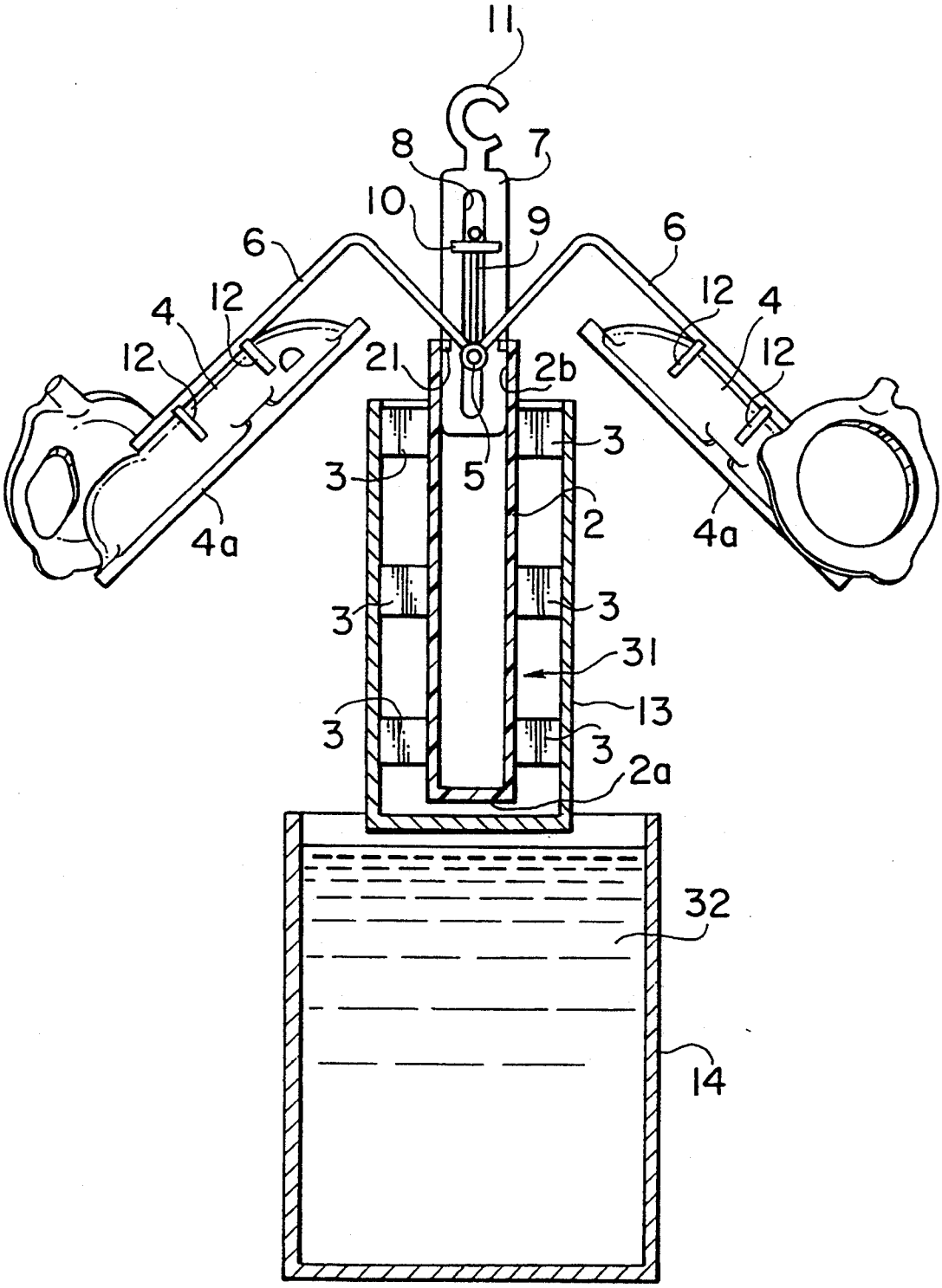
FIG. 5 is a view showing a process for adhering the product portion foam pattern to the gate portion foam patterns.

FIG. 5 shows a process for adhering a product portion foam pattern 4 to gate portion foam patterns 3. As is shown in FIG. 5, the adhesive supply jig 13 including the hot melt 32 therein is lifted above the tank 14 by the hydraulic cylinder (not shown), and then the hot melt 32 is coated to edge surfaces of the gate portion foam patterns 3, that is, surfaces of the foam patterns 3 are adhered to the product portion foam pattern 4.

Next, the adhesive supply jig 13 is lowered by the hydraulic cylinder, and then the rod 9 is operated to be lifted so that the couple of handling devices 6 are closed around the supporting shaft 5.

As a result, the product portion foam pattern 4 is adhered so as to be fixed to the gate portion foam patterns 3. FIG. 6 shows the lost foam pattern 1 for molding in which such an adhering process has been carried out.

Figure 7:
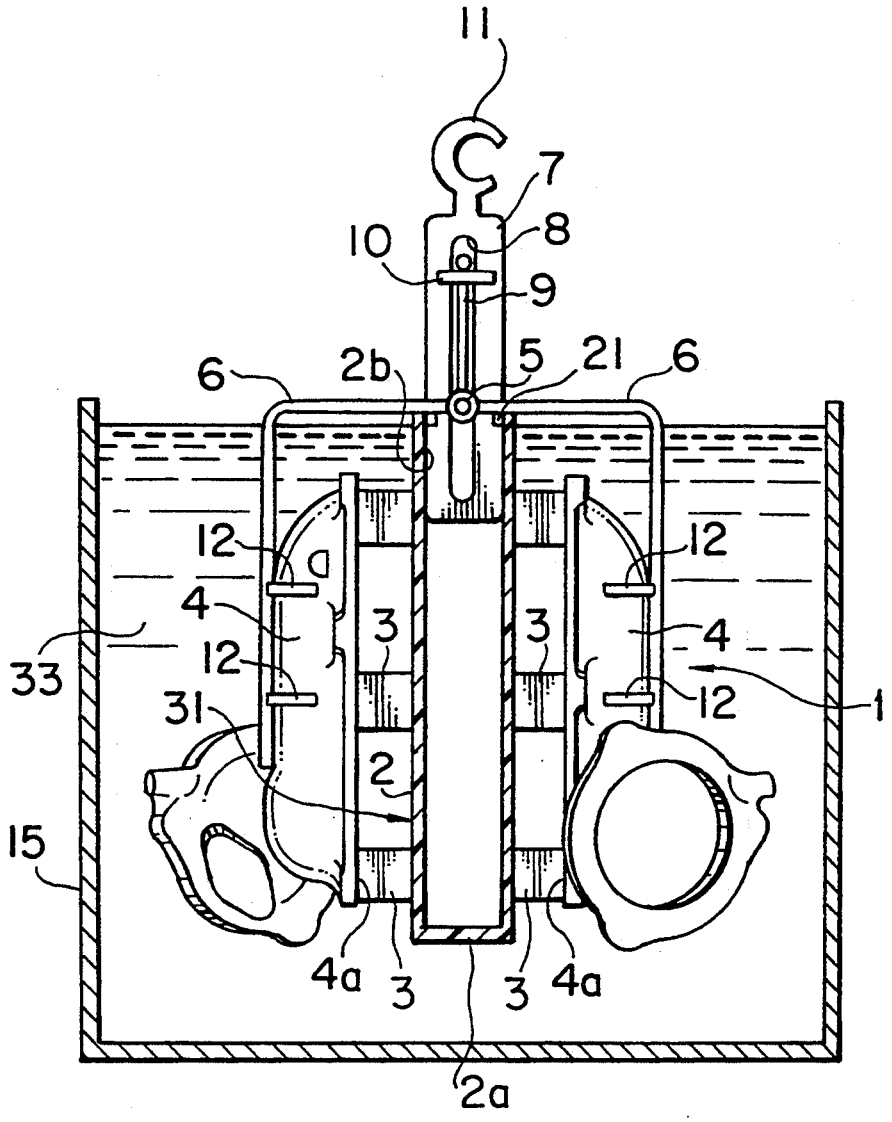
FIG. 7 is a view showing a process for coating a lost foam pattern for molding with facing material.

FIG. 7 shows a process for coating the lost foam pattern 1 for molding with facing material. There is provided a facing material tank 15 for storing facing material 33 therein. After the adhering process shown in FIG. 6 is carried out, under the condition that the lost foam pattern 1 is held by the couple of handling devices 6, the lost foam pattern 1 with handling devices 6 is dipped into the facing material tank 15, and the lost foam pattern 1 for molding is coated with the facing material 33. When the lost foam pattern 1 with handling devices 6 is dipped into the facing material tank 15, the lost foam pattern 1 has buoyancy. However, the couple of handling devices 6 and the plurality of holding nails 12 work as a reinforcement member for the lost foam pattern 1 and therefore can prevent disadvantages caused by the buoyancy of the lost foam pattern 1.

Figure 8:
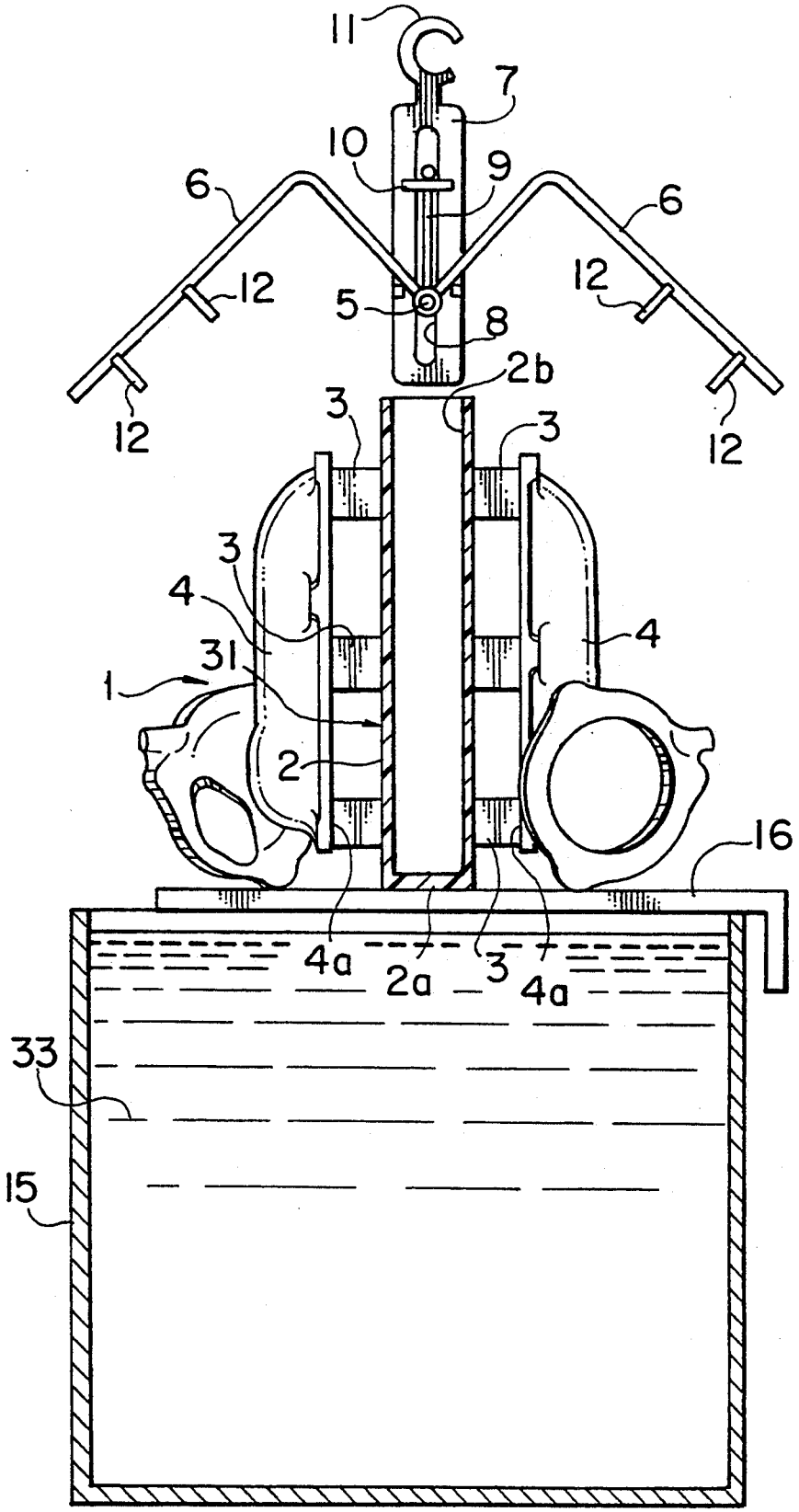
FIG. 8 is a view showing a process for lifting a lost foam pattern for molding from a facing material tank.

FIG. 8 shows a process for lifting the lost foam pattern 1 for molding from the facing material tank 15. As is shown in FIG. 8, the lost foam pattern 1 for molding dipped in the facing material tank 15 is lifted outside of the tank 15, and the bottom portion of the lost foam pattern 1 is supported by the supporting plate 16. After that, the lost foam pattern 1 is released from being held by the couple of handling devices 6, and then the jig 7 with the handling devices 6 and the like is conveyed to a washing area where the facing material 33 on the jig 7 is washed out.

Figure 9:
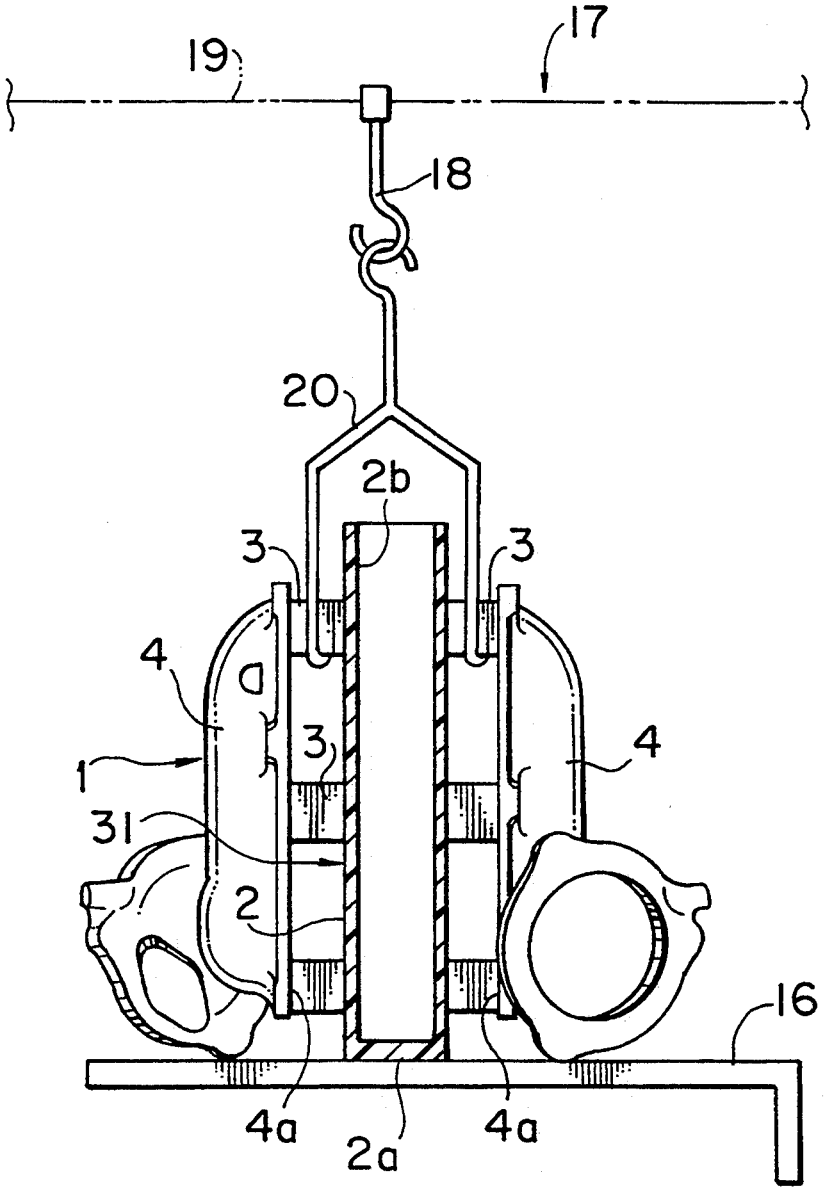
FIG. 9 is a view showing a process for conveying a lost foam pattern for molding to a drying area.

FIG. 9 shows a process for conveying the lost foam pattern 1 for molding to a drying area. After the coating process in FIG. 7 and the lifting process in FIG. 8 are carried out, the lost foam pattern 1 for molding is conveyed to a drying room (not shown) by a conveying device 17 which includes a conveyer 19 with a hook 18 and a hanger 20 for hanging the lost foam pattern 1. After the lost foam pattern 1 is conveyed to the drying room, a mold facing film (film thickness is about 0.5 mm) is made on the external surface of the lost foam pattern 1 by drying the lost foam pattern 1 in the drying room. Gas of the gasified lost form 1 diffuses into silica sand 34 (see FIG. 10) through the mold facing film while the molten metal is being poured into the lost foam pattern 1. At the same time, the mold facing film also works so that the silica sand 34 is not destroyed by gas pressure.

Figure 10:
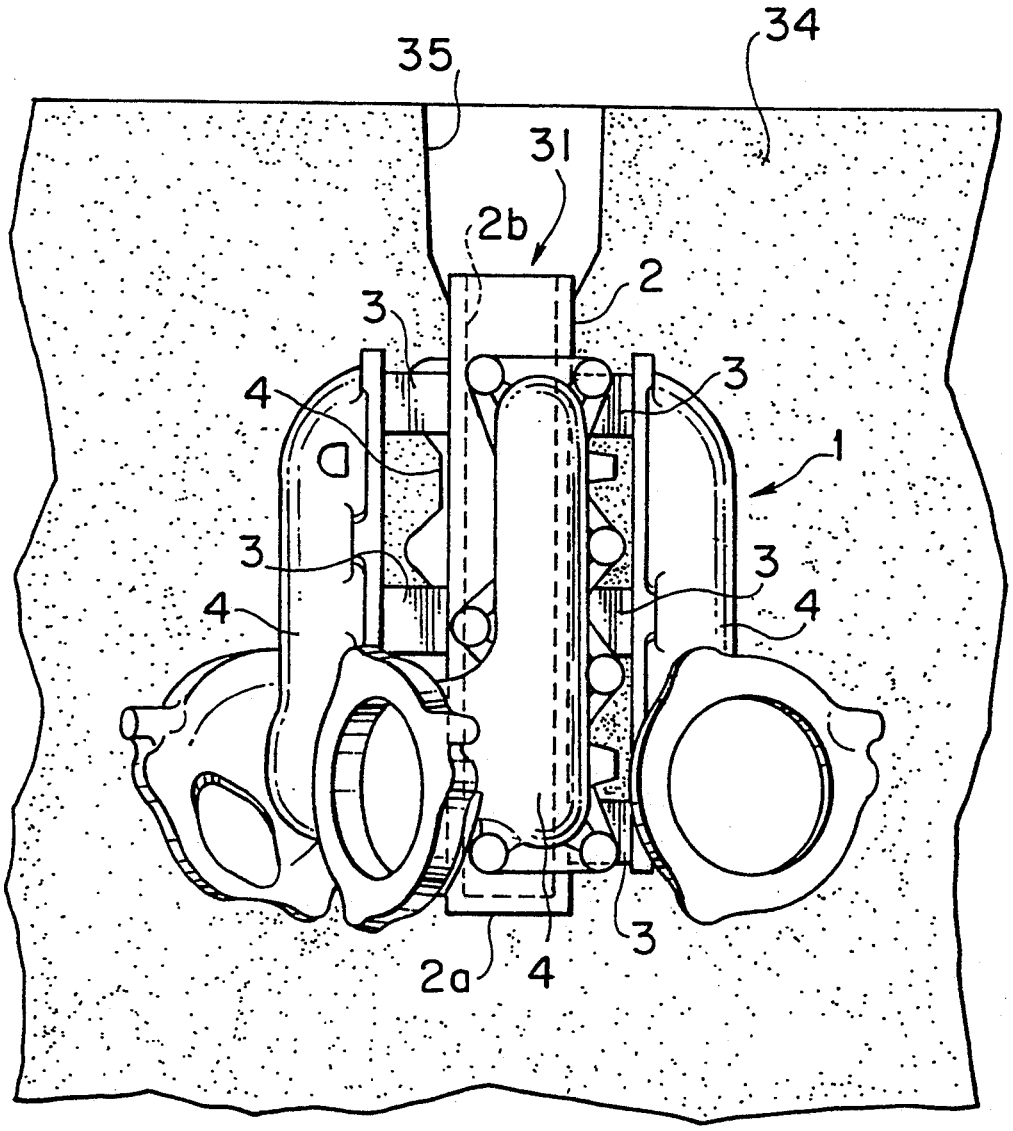
FIG. 10 is a view showing a process for burying a lost foam pattern in a sand mold.

FIG. 10 shows a process for burying the lost foam pattern 1 in a sand mold. After the adhering process, the coating process and the drying process, the lost foam pattern 1 for molding is completed. Then, as shown in FIG. 10, the lost foam pattern 1 is buried in the silica sand 34 which is fire-resistant. When the molten metal is poured into the lost foam pattern 1 through the sprue 35 at the molten metal pouring speed of 4 kg/sec, the lost foam pattern 1 made out of the expanded polymethylmethacrylate resin is replaced with the molten metal, and thus the exhaust manifold of the automobile component is finally obtained.

According to the above-mentioned embodiment of the present invention, since the runner portion foam pattern 2 is provided with the hollow portion 31, the molten metal can be prevented from flowing in the reverse direction during the molten metal pouring process. Further, since the product portion foam pattern 4 is connected to the runner portion foam pattern 2 through the plurality of gate portion foam patterns 3 provided on the external surface of the hollow portion 31 of the foam pattern 2, the product portion foam pattern 4 can be supported by sufficient force, and further production of misruns can be prevented.

Moreover, since the upper edge opening portion **2*b* works as both a sprue portion and a positioning portion for the lost foam pattern 1, the jig 7 can be positioned accurately into the upper edge opening portion 2*b* of the runner portion foam pattern 2. As a result, during the coating process in which the the lost foam pattern 1 is dipped in the facing material 33, the above-mentioned jig 7 with the couple of handling devices 6 and the holding nails 12 can reinforce the lost foam pattern 1**.

The present invention has been described with reference to the preferred embodiments thereof which are intended to be illustrative rather than limiting. Various changes and modifications may be made without departing from the spirit and scope of the present invention as defined in the following claims.

What is claimed is:

1. A method of manufacturing a molding product by using an evaporative foam pattern, made out of synthetic resin which is decomposed and gasified by molten metal, comprising the steps of:

providing a runner portion foam pattern so as to extend vertically, said runner portion foam pattern including a hollow portion and a base portion;

providing a plurality of short-sized gate portion foam patterns integrally on external surfaces of the hollow portion of the runner portion foam pattern;

providing a product portion foam pattern;

positioning and fixing a jig member to an upper opening portion of the runner portion foam pattern;

attaching a handling device to the product portion foam pattern, said handling device being movably mounted to the jig member at its end;

coating an adhesive on edge surfaces of said short-sized gate portion foam pattern;

adhering the product portion foam pattern to the external surfaces of the hollow portion through the plurality of short-sized gate portion foam patterns so as to provide the evaporative foam pattern by closing the handling device;

burying the evaporative foam pattern in a sand mold; and pouring molten metal into the evaporative foam pattern through the upper opening portion of the runner portion foam pattern.

2. A method in accordance with claim 1 and further comprising the step of coating facing material on the evaporative foam pattern by dipping the evaporative foam pattern into the facing material while holding the runner portion foam pattern through the jig member after adhering said product portion foam pattern to said external surfaces.

3. A method in accordance with claim 2 and further comprising the step of drying the facing material coated on the evaporative foam pattern after coating the facing material on the evaporative foam pattern.

4. A method in accordance with claim 1 and further comprising the step of coating said adhesive on edge surfaces of the short-sized gate portion foam patterns by opening the handling device so that the runner portion foam pattern is separated from the product portion foam pattern.

5. A method in accordance with claim 1 and further comprising the step of forming said synthetic resin from expanded polymethylmethacrylate resin.

* * * * *